US007302199B2

(12) United States Patent
German et al.

(10) Patent No.: US 7,302,199 B2
(45) Date of Patent: Nov. 27, 2007

(54) DOCUMENT PROCESSING SYSTEM AND METHODS FOR REDUCING STRESS THEREIN

(75) Inventors: Kristine A. German, Webster, NY (US); Robert M. Lofthus, Webster, NY (US)

(73) Assignee: Xerox Corporation, Stamford, CT (US)

( * ) Notice: Subject to any disclaimer, the term of this patent is extended or adjusted under 35 U.S.C. 154(b) by 269 days.

(21) Appl. No.: 11/136,959

(22) Filed: May 25, 2005

(65) Prior Publication Data

US 2006/0269310 A1 Nov. 30, 2006

(51) Int. Cl.
*G03G 15/00* (2006.01)

(52) U.S. Cl. ..... 399/82

(58) Field of Classification Search ..... 399/82
See application file for complete search history.

(56) References Cited

U.S. PATENT DOCUMENTS

| | | | |
|---|---|---|---|
| 4,579,446 | A | 4/1986 | Fujino et al. |
| 4,587,532 | A | 5/1986 | Asano |
| 4,836,119 | A | 6/1989 | Siraco et al. |
| 5,004,222 | A | 4/1991 | Dobashi |
| 5,080,340 | A | 1/1992 | Hacknauer et al. |
| 5,095,342 | A | 3/1992 | Farrell et al. |
| 5,095,369 | A | 3/1992 | Ortiz et al. |
| 5,159,395 | A | 10/1992 | Farrell et al. |
| 5,208,640 | A | 5/1993 | Horie et al. |
| 5,272,511 | A | 12/1993 | Conrad et al. |
| 5,326,093 | A | 7/1994 | Sollitt |
| 5,435,544 | A | 7/1995 | Mandel |
| 5,473,419 | A | 12/1995 | Russel et al. |
| 5,489,969 | A | 2/1996 | Soler et al. |
| 5,504,568 | A | 4/1996 | Saraswat et al. |
| 5,525,031 | A | 6/1996 | Fox |
| 5,557,367 | A | 9/1996 | Yang et al. |
| 5,568,246 | A | 10/1996 | Keller et al. |
| 5,570,172 | A | 10/1996 | Acquaviva |
| 5,596,416 | A | 1/1997 | Barry et al. |
| 5,629,762 | A | 5/1997 | Mahoney et al. |
| 5,696,893 | A | 12/1997 | Fromherz et al. |
| 5,701,557 | A | 12/1997 | Webster et al. |
| 5,710,968 | A | 1/1998 | Clark et al. |
| 5,778,377 | A | 7/1998 | Marlin et al. |
| 5,884,910 | A | 3/1999 | Mandel |

(Continued)

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner*—Quana Grainger
(74) *Attorney, Agent, or Firm*—Eugene O. Palazzo; Fay Sharpe LLP

(57) ABSTRACT

In a document processing system, print jobs each including a plurality of sheets to be processed are received. Current operational capabilities of at least one processing unit of a document processing system are determined, which processing unit has a predetermined nominal operational latitude. A sequence of interleaved sheet processing of the sheets of each print job is scheduled based at least on determination of the operational capabilities of the processing unit. Short term average departures from the nominal operational latitude of the processing unit are reduced. An operational latitude of the document processing system is increased.

21 Claims, 4 Drawing Sheets

U.S. PATENT DOCUMENTS

| | | | | |
|---|---|---|---|---|
| 5,995,721 | A | 11/1999 | Rourke et al. | |
| 6,059,284 | A | 5/2000 | Wolf et al. | |
| 6,125,248 | A | 9/2000 | Moser | |
| 6,241,242 | B1 | 6/2001 | Munro | |
| 6,297,886 | B1 | 10/2001 | Cornell | |
| 6,341,773 | B1 | 1/2002 | Aprato et al. | |
| 6,384,918 | B1 | 5/2002 | Hubble, III et al. | |
| 6,450,711 | B1 | 9/2002 | Conrow | |
| 6,476,376 | B1 | 11/2002 | Biegelsen et al. | |
| 6,476,923 | B1 | 11/2002 | Cornell | |
| 6,493,098 | B1 | 12/2002 | Cornell | |
| 6,537,910 | B1 | 3/2003 | Burke et al. | |
| 6,550,762 | B2 | 4/2003 | Stoll | |
| 6,554,276 | B2 | 4/2003 | Jackson et al. | |
| 6,577,925 | B1 | 6/2003 | Fromherz | |
| 6,607,320 | B2 | 8/2003 | Bobrow et al. | |
| 6,608,988 | B2 | 8/2003 | Conrow | |
| 6,612,566 | B2 | 9/2003 | Stoll | |
| 6,612,571 | B2 | 9/2003 | Rider | |
| 6,621,576 | B2 | 9/2003 | Tandon et al. | |
| 6,633,382 | B2 | 10/2003 | Hubble, III et al. | |
| 6,639,669 | B2 | 10/2003 | Hubble, III et al. | |
| 6,819,906 | B1 | 11/2004 | Herrmann et al. | |
| 6,856,411 | B1 | 2/2005 | Purvis et al. | |
| 7,254,355 | B2 * | 8/2007 | Sahay | 399/82 |
| 2002/0078012 | A1 | 6/2002 | Ryan et al. | |
| 2002/0097428 | A1 * | 7/2002 | Ferlitsch | 358/1.15 |
| 2002/0103559 | A1 | 8/2002 | Gartstein | |
| 2003/0077095 | A1 | 4/2003 | Conrow | |
| 2004/0085561 | A1 | 5/2004 | Fromherz | |
| 2004/0085562 | A1 | 5/2004 | Fromherz | |
| 2004/0088207 | A1 | 5/2004 | Fromherz | |
| 2004/0150156 | A1 | 8/2004 | Fromherz et al. | |
| 2004/0150158 | A1 | 8/2004 | Biegelsen et al. | |
| 2004/0153983 | A1 | 8/2004 | McMillan | |
| 2004/0216002 | A1 | 10/2004 | Fromherz et al. | |
| 2004/0225391 | A1 | 11/2004 | Fromherz et al. | |
| 2004/0225394 | A1 | 11/2004 | Fromherz et al. | |
| 2004/0247365 | A1 | 12/2004 | Lofthus et al. | |
| 2006/0263110 | A1 * | 11/2006 | Sahay | 399/82 |

OTHER PUBLICATIONS

Desmond Fretz, "Cluster Printing Solution Announced", Today at Xerox (TAX), No. 1129, Aug. 3, 2001.

U.S. Appl. No. 10/761,522, filed Jan. 21, 2004, Mandel et al.
U.S. Appl. No. 10/785,211, filed Feb. 24, 2004, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/917,768, filed Aug. 13, 2004, Lofthus et al.
U.S. Appl. No. 10/924,106, filed Aug. 23, 2004, Lofthus et al.
U.S. Appl. No. 10/924,113, filed Aug. 23, 2004, deJong et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,326, filed Nov. 30, 2004, Grace et al.
U.S. Appl. No. 10/999,450, filed Nov. 30, 2004, Lofthus et al.
U.S. Appl. No. 11/000,158, filed Nov. 30, 2004, Roof.
U.S. Appl. No. 11/000,168, filed Nov. 30, 2004, Biegelsen et al.
U.S. Appl. No. 11/000,258, filed Nov. 30, 2004, Roof.
U.S. Appl. No. 11/001,890, filed Dec. 2, 2004, Lofthus et al.
U.S. Appl. No. 11/002,528, filed Dec. 2, 2004, Lofthus et al.
U.S. Appl. No. 11/051,817, filed Feb. 4, 2005, Moore et al.
U.S. Appl. No. 11/070,681, filed Mar. 2, 2005, Viturro et al.
U.S. Appl. No. 11/081,473, filed Mar. 16, 2005, Moore.
U.S. Appl. No. 11/069,020, filed Feb. 28, 2005, Lofthus et al.
U.S. Appl. No. 11/089,854, filed Mar. 25, 2005, Clark et al.
U.S. Appl. No. 11/090,498, filed Mar. 25, 2005, Clark.
U.S. Appl. No. 11/090,502, filed Mar. 25, 2005, Mongeon.
U.S. Appl. No. 11/095,378, filed Mar. 31, 2005, Moore et al.
U.S. Appl. No. 11/094,998, filed Mar. 31, 2005, Moore et al.
U.S. Appl. No. 11/094,864, filed Mar. 31, 2005, de Jong, et al.
U.S. Appl. No. 11/095,872, filed Mar. 31, 2005, Julien et al.
U.S. Appl. No. 11/102,355, filed Apr. 8, 2005, Fromherz et al.
U.S. Appl. No. 11/084,280, filed Mar. 18, 2005, Mizes.
U.S. Appl. No. 11/109,566, filed Apr. 19, 2005, Mandel et al.
U.S. Appl. No. 11/109,558, filed Apr. 19, 2005, Furst et al.
U.S. Appl. No. 11/109,996, filed Apr. 20, 2005, Mongeon et al.
U.S. Appl. No. 11/093,229, filed Mar. 29, 2005, Julien.
U.S. Appl. No. 11/102,899, filed Apr. 8, 2005, Crawford et al.
U.S. Appl. No. 11/102,910, filed Apr. 8, 2005, Crawford et al.
U.S. Appl. No. 11/115,766, filed Apr. 27, 2005, Grace.
U.S. Appl. No. 11/120,589, filed May 3, 2005, Contino.
U.S. Appl. No. 11/102,332, filed Apr. 8, 2005, Hindi et al.

* cited by examiner

DOCUMENT PROCESSING SYSTEM AND METHODS FOR REDUCING STRESS THEREIN

BACKGROUND

The present exemplary embodiment relates to printing systems. It finds particular application in conjunction with scheduling print jobs in print or marking systems with one or more electrophotographic or xerographic print engines. However, it is to be appreciated that the present exemplary embodiment is also amenable to other like applications.

The multiple marking engine systems enable high overall outputs to be achieved by printing portions of the same document on multiple printers. Such systems are commonly referred to as "tandem engine" printers, "parallel" printers, or "cluster printing" (in which an electronic print job may be split up for distributed higher productivity printing by different printers, such as separate printing of the color and monochrome pages. Examples of such a system are described below in application Ser. Nos. 10/924,459 and 10/917,768. Such a system feeds paper from a common source to a plurality of printers, which may be horizontally and/or vertically stacked. Printed media from the various printers is then taken from the printers to a finisher where the sheets associated with a single print job are assembled.

Typically, printing systems operate by serially processing sheets from jobs that are in a serial job queue, where the order of the jobs in the queue is the order in which the jobs were submitted. As is known by product developers and operators of such systems, certain classes of jobs stress the print engine and lead to poor performance or failures. Printing an extended job with particularly high or low area coverage can create wear or charging distribution problems in the developer sump, subsequently leading to problems such as high background, bead carry out, drift in developed mass per area, and so on. Stress jobs are often said to be outside of the operational latitude of the system which leads to a reduced performance of the print engines. While countermeasures are generally known for recovering from the performance shortfalls or failures associated with the operation outside of the print system's latitude, there is usually collateral waste or loss in productivity. In some circumstances, closed loop controls may be able to open system latitude or maintain system performance. However, this approach may be costly or even non-viable to develop, and may decrease productivity or increase waste when implemented.

One example of a stress causing job is one where the long term average toner consumption per page is low for a monochrome engine or for any color of a process color engine. This typically occurs when a print job has a preponderance of low area coverage monochrome pages or a preponderance of low area coverage images for one or more of the color separations for process color pages. If too low of an average consumption rate for any toner persists for too many pages, the marking materials are not used at a sufficient rate, and the supply is not regularly replenished with the fresh material. Over an extended period, the marking material stored in the developer housing becomes damaged due to the constant churning of the material under high shear. Examples of damage are the impaction of toner particles onto carrier beads, the impaction of additives onto toner, and the degradation of carrier bead coatings. Surface charge distribution of materials damaged in the developer housing can become skewed or pathologically abnormal. Images printed with the damaged material will have one or more image defects, such as color imbalances, fine line growth or shrinkage, or high levels of background toner in the nominally white region of a page, which can appears as a color shift or dirt over the entire printable area of the page. A wasteful countermeasure to printing low area coverage jobs is to purge significant quantities of damaged toner from the developer sump. Fresh toner or toner with small amounts of carrier can then be dispensed into the developer sump to restore the charging performance of the marking materials.

There is a need for methods and apparatuses that overcome the aforementioned problems and others.

CROSS REFERENCE TO RELATED APPLICATIONS

The following applications, the disclosures of each being totally incorporated herein by reference are mentioned:

The following copending applications, the disclosures of which are incorporated by reference in their entireties, are mentioned:

U.S. patent application Ser. No. 11/137,634, filed contemporaneously herewith, entitled PRINTING SYSTEM, by Robert M. Lofthus, et al.;

U.S. patent application Ser. No.11/137,251, filed contemporaneously herewith, entitled SCHEDULING SYSTEM, by Robert M. Lofthus, et al.

U.S. application Ser. No. 10/924,458, filed Aug. 23, 2004, entitled "PRINT SEQUENCE SCHEDULING FOR RELIABILITY," by Robert M. Lofthus, et al.;

U.S. application Ser. No. 10/953,953, filed Sep. 29, 2004, entitled "CUSTOMIZED SET POINT CONTROL FOR OUTPUT STABILITY IN A TIPP ARCHITECTURE," by Charles A. Radulski et al.;

U.S. application Ser. No. 11/094,998, filed Mar. 31, 2005, entitled "PARALLEL PRINTING ARCHITECTURE WITH PARALLEL HORIZONTAL PRINTING MODULES," by Steven R. Moore, et al.;

U.S. application Ser. No. 11/102,899, filed Apr. 8, 2005, entitled "SYNCHRONIZATION IN A DISTRIBUTED SYSTEM," by Lara S. Crawford, et al.;

U.S. application Ser. No. 11/102,910, filed Apr. 8, 2005, entitled "COORDINATION IN A DISTRIBUTED SYSTEM," by Lara S. Crawford, et al.;

U.S. application Ser. No. 11/102,355, filed Apr. 8, 2005, entitled "COMMUNICATION IN A DISTRIBUTED SYSTEM," by Markus P. J. Fromherz, et al.;

U.S. application Ser. No. 11/102,332, filed Apr. 8, 2005, entitled "ON-THE-FLY STATE SYNCHRONIZATION IN A DISTRIBUTED SYSTEM," by Haitham A. Hlndi;

U.S. application Ser. No. 11/122,420, filed May 5, 2005, entitled "PRINTING SYSTEM AND SCHEDULING METHOD," by Austin L. Richards.

REFERENCES

The following references, the disclosures of which are incorporated by reference relate generally to scheduling in a printing system:

U.S. Pat. No. 5,095,369 to Ortiz, et al. discloses a method for enhancing productivity in an electronic printer incorporating finishing activities and operating in a job streaming mode. Printing and collating of sets of original scanned documents are controlled so that collated sets are successively presented by the printer to the finisher nearly coincident with conclusion of the finishing activity being accomplished for a current job. The system uses a predictive algorithm which is used to increase reliability of printer components by cycling down the printer between jobs in situations where the finishing activity for a current job requires an extraordinarily long time to complete compared with the cycle down/cycle up time of the printer.

U.S. Pat. No. 5,701,557 to Webster, et al. describes an image processing apparatus with a controller and plural modules and a method to define a configuration of the image processing machine.

U.S. Pat. No. 6,856,411 to Purvis, et al. discloses a scheduler for picking an itinerary in a printing machine to schedule the processing of sheets through several modules of the printing machine. The scheduler uses hard "must have" policies and soft "desired" policies to select an itinerary.

U.S. Pat. No. 5,696,893 to Fromherz, et al. describes a method for modeling a printing machine specifying a structure model with its physical and software interface and internal resource requirements, and a behavior model to describe capabilities of a component with its description of work units, transformation of work units, timed events, resource allocations, constraints and restrictions.

U.S. application Ser. No. 10/924,458 filed Aug. 23, 2004 entitled PRINT SEQUENCE SCHEDULING FOR RELIABILITY, by Robert M. Lofthus, et al.($A_{3548}$-US-NP) discloses a scheduler for a printing system including a plurality of printers which schedules a sequence for printing a plurality of print jobs by the printers based on minimizing printer downtime or maximizing continuous printer run time.

The following references, the disclosures of which are incorporated by reference in their entireties, relate to what have been variously called "tandem engine" printers, "parallel" printers, or "cluster printing" (in which an electronic print job may be split up for distributed higher productivity printing by different printers, such as separate printing of the color and monochrome pages), and "output merger" or "interposer" systems: U.S. Pat. No. 5,568,246 to Keller, et al., U.S. Pat. No. 4,587,532 to Asano, U.S. Pat. No. 5,570,172 to Acquaviva, U.S. Pat. No. 5,596,416 to Barry, et al.; U.S. Pat. No. 5,995,721 to Rourke et al; U.S. Pat. No. 4,579,446 to Fujino; U.S. Pat. No. 5,389,969 to Soler, et al.; a 1991 "Xerox Disclosure Journal" publication of November-December 1991, Vol. 16, No. 6, pp. 381-383 by Paul F. Morgan; and a Xerox Aug. 3, 2001 "TAX" publication product announcement entitled "Cluster Printing Solution Announced."

BRIEF DESCRIPTION

In accordance with one aspect, a method is disclosed. Print jobs each including a plurality of sheets to be processed are received. Current operational capabilities of at least one processing unit of a document processing system are determined, which processing unit has a predetermined nominal operational latitude. A sequence of interleaved sheet processing of the sheets of each print job is scheduled based at least on determination of the operational capabilities of the processing unit. Short term average departures from the nominal operational latitude of the processing unit are reduced. An operational latitude of the document processing system is increased.

In accordance with another aspect, a document processing system is disclosed. The document processing system includes processing units which at least include: a media feeding processing unit which includes a feeder for storing a plurality of individual media sheets, a marking engine processing unit which includes a marking engine in operative communication with the feeder for receiving media sheets from the feeder and marking a series of individual media sheets, and a finishing processing unit which includes finishing destinations in operative communication with the marking engine, which finishing destinations receive and accumulate a series of individual marked media sheets from the marking engine. A scheduler receives print jobs each having a plurality of sheets to be processed and schedules a series of consecutive sheets of each received print job to be processed with the media feeding, marking engine, and finishing processing units in an interleaved fashion.

DETAILED DESCRIPTION

Figure 1:
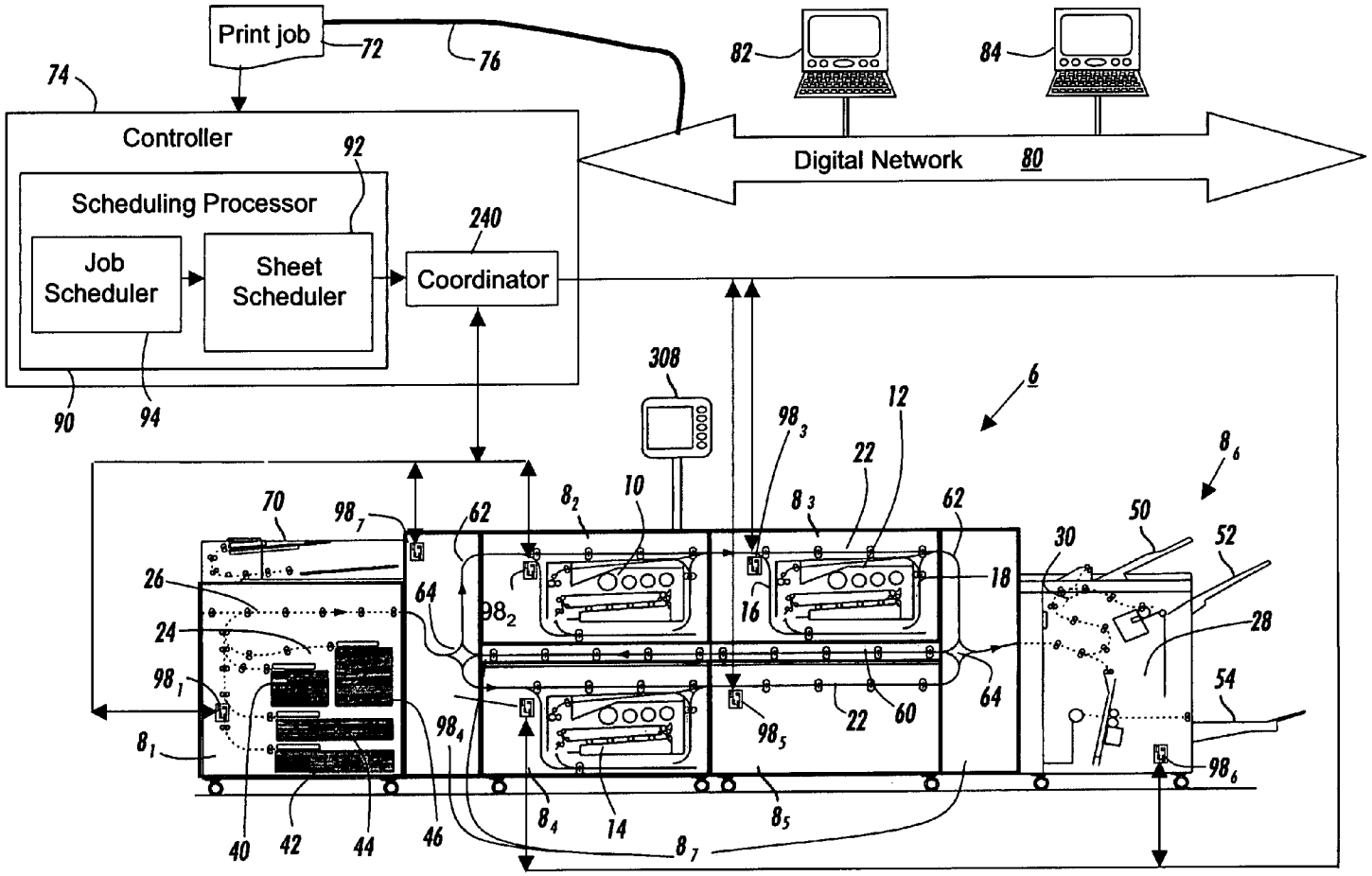
FIG. 1 is a view of a document processing system with multiple marking engines.

With reference to FIG. 1, an example printing or document processing system 6 is a modular printing system including first, second, . . . , nth processing units or elements $\mathbf{8}_1$, $\mathbf{8}_2$, $\mathbf{8}_3$, $\mathbf{8}_4$, $\mathbf{8}_5$, $\mathbf{8}_6$, . . . , $\mathbf{8}_n$. In one embodiment, the first, second, third, fourth, fifth and sixth processing units $\mathbf{8}_1$, $\mathbf{8}_2$, $\mathbf{8}_3$, $\mathbf{8}_4$, $\mathbf{8}_5$, $\mathbf{8}_6$ are interconnected by a seventh or print media processing unit $\mathbf{8}_7$, i.e., sheet conveyance processing unit. The processing units $\mathbf{8}_1$, $\mathbf{8}_2$, $\mathbf{8}_3$, $\mathbf{8}_4$, $\mathbf{8}_5$, $\mathbf{8}_6$, $\mathbf{8}_7$, . . . , $\mathbf{8}_n$ cooperate to produce completely assembled print jobs at high rate. While seven processing units are illustrated, the plurality of processing units may include two, three, four, five, six, seven, eight, or more processing units.

For example, in the printing system 6, the second, third and fourth processing units $\mathbf{8}_2$, $\mathbf{8}_3$, $\mathbf{8}_4$ include associated marking engines 10, 12, 14 and associated entry and exit inverter/bypasses 16, 18. In some embodiments, one or more operational components of the processing units $\mathbf{8}_1$, $\mathbf{8}_2$, $\mathbf{8}_3$, $\mathbf{8}_4$, $\mathbf{8}_5$, $\mathbf{8}_6$, $\mathbf{8}_7$, . . . , $\mathbf{8}_n$ are removable. For example, in FIG. 1, an integrated marking engine and entry and exit inverter/bypasses of the fifth processing unit $\mathbf{8}_5$ are shown as removed, leaving only a forward or upper paper path 22. In this manner, for example, the functional marking engine portion can be removed for repair, or can be replaced to effectuate an upgrade or modification of the printing system 6. The printing system 6 remains operational with the marking portion of the fifth processing unit $\mathbf{8}_5$ removed, broken, or otherwise unavailable, albeit with the intended loss of marking capability for the fifth processing unit $\mathbf{8}_5$. While three marking engines 10, 12, 14 are illustrated (with the fifth processing unit marking engine being removed) the number of marking engines can be one, two, three, four, five, or more. Providing at least two marking engines typically provides enhanced features and capabilities for the printing system 6 since marking tasks can be distributed amongst the at least two marking engines. Some or all of the marking engines 10, 12, 14 may be identical to provide redundancy or improved productivity through parallel printing. Alternatively or additionally, some or all of the marking engines 10, 12, 14 may be different to provide different capabilities. For example, the marking engines 10, 12 may be color marking engines, while the marking engine 14 may be a black (K) marking engine.

The illustrated marking engines 10, 12, 14 employ xerographic printing technology, in which an electrostatic image is formed and coated with a toner material, and then transferred and fused to paper or another print medium by application of heat and pressure. However, marking engines employing other printing technologies can be provided as processing units, such as marking engines employing ink jet transfer, thermal impact printing, or so forth. The processing units of the printing system 6 can also be other than marking engines; for example, the first processing unit $\mathbf{8}_1$ is a print media source or print media feeding processing unit which includes a feeder 24 and associated print media conveying components 26. The media feeding processing unit $\mathbf{8}_1$ supplies paper or other print media for printing. The seventh processing unit $\mathbf{8}_7$ is a finishing processing unit which includes a finisher 28 and associated print media components 30. The finishing processing unit $\mathbf{8}_6$ provides finishing capabilities such as collation, stapling, folding, stacking, hole-punching, binding, postage stamping, or so forth. In the present invention, a plurality of final media destinations is provided.

The print media source processing unit $\mathbf{8}_1$ includes print media sources or input trays 40, 42, 44, 46 connected with the print media conveyance processing unit 20 to provide selected types of print media. While four print media sources are illustrated, the number of print media sources can be one, two, three, four, five, or more. Moreover, while the illustrated print media sources 40, 42, 44, 46 are embodied as components of the dedicated print media source processing unit $\mathbf{8}_1$, in other embodiments one or more of the marking engine processing units $\mathbf{8}_2$, $\mathbf{8}_3$, $\mathbf{8}_4$ or $\mathbf{8}_5$ may include its own dedicated print media source instead of or in addition to those of the print media source processing unit $\mathbf{8}_1$. Each of the print media sources 40, 42, 44, 46 can store sheets of the same type of print media, or can store different types of print media. For example, the print media sources 42, 44 may store the same type of large-size paper sheets, print media source 40 may store company letterhead paper, and the print media source 46 may store letter-size paper. The print media can be substantially any type of media upon which one or more of the marking engines 10, 12, 14 can print, such as: high quality bond paper, lower quality "copy" paper, overhead transparency sheets, high gloss paper, and so forth.

The print media conveyance processing unit $\mathbf{8}_7$ is controllable to acquire sheets of a selected print media from the print media sources 40, 42, 44, 46, which are disposed within the media feeding processing unit $\mathbf{8}_1$, transfer each acquired sheet to one or more of the marking engines 10, 12, 14 (and the fifth processing unit marking engine when installed) to perform selected marking tasks, transfer each sheet to the finishing processing unit $\mathbf{8}_6$ to perform finishing tasks according to a job description associated with each sheet and according to the capabilities of the finisher. Since multiple jobs arrive at the finishing processing unit $\mathbf{8}_6$ during a common time interval, the finisher 28 includes two or more print media finishing destinations or stackers 50, 52, 54 for collecting sequential pages of each print job that is being contemporaneously printed by the printing system 6. Generally, the number of the print jobs that the printing system 6 can contemporaneously process is limited to the number of available stackers. While three finishing destinations are illustrated, the printing system 6 may include two, three, four, or more print media finishing destinations. The finisher 28 deposits each sheet after processing in one of the print media finishing destinations 50, 52, 54, which may be trays, pans, stackers and so forth. While only one finishing processing unit is illustrated, it is contemplated that two, three, four or more finishing processing units can be employed in the printing system 6.

Bypass routes in each marking engine processing unit $\mathbf{8}_2$, $\mathbf{8}_3$, $\mathbf{8}_4$, $\mathbf{8}_5$ provide a means by which the sheets can pass through the corresponding processing unit $\mathbf{8}_2$, $\mathbf{8}_3$, $\mathbf{8}_4$, $\mathbf{8}_5$ without interacting with the marking engines therein. Branch paths are also provided in each processing unit $\mathbf{8}_2$, $\mathbf{8}_3$, $\mathbf{8}_4$, $\mathbf{8}_5$ to take the sheet into the associated marking engine and to deliver the sheet back to the upper or forward paper path 22 of the associated processing unit. In the fifth processing unit $\mathbf{8}_5$, the branch paths are presently removed along with the marking engine; however, the upper or forward paper path 22 of the processing unit $\mathbf{8}_5$ maintains sheet handling continuity of the printing system 6. The sheet conveyance processing unit $\mathbf{8}_7$, which includes a middle conveyor 60, side conveyors 62 and 'clover-leaf' junction points 64, can receive sheets from the media feeding processing unit $\mathbf{8}_1$ and distribute the received sheets to the second and fourth processing units $\mathbf{8}_2$, $\mathbf{8}_4$, which in turn send the sheets to the third and fifth processing units $\mathbf{8}_3$, $\mathbf{8}_5$. The seventh processing unit $\mathbf{8}_7$ also receives sheets from the third and fifth processing units $\mathbf{8}_3$, $\mathbf{8}_5$ and can send the sheets forward to the finishing processing unit $\mathbf{8}_6$ or back to the second and fourth processing units $\mathbf{8}_2$, $\mathbf{8}_4$. This enables the illustrated arrangement in which the second, third, fourth and fifth processing units $\mathbf{8}_2$, $\mathbf{8}_3$, $\mathbf{8}_4$, $\mathbf{8}_5$ are arranged two-dimensionally. In a linear arrangement of the processing units (not illustrated), the 'clover-leaf' junction points 64 in the sheet conveyance processing unit $\mathbf{8}_7$ are suitably omitted.

The printing system 6 executes print jobs. Print job execution involves printing selected text, line graphics, images, machine ink character recognition (MICR) notation, or so forth on front, back, or front and back sides or pages of one or more sheets of paper or other print media. In general, some sheets may be left completely blank. In general, some sheets may have mixed color and black-and-white printing. Execution of the print job may also involve collating the sheets in a certain order. Still further, the print job may include folding, stapling, punching holes into, or otherwise physically manipulating or binding the sheets. The printing, finishing, paper handing, and other processing operations that can be executed by the printing system 6 are determined by the capabilities of the processing units $\mathbf{8}_1$, $\mathbf{8}_2$, $\mathbf{8}_3$, $\mathbf{8}_4$, $\mathbf{8}_5$, $\mathbf{8}_6$, $\mathbf{8}_7$, . . . , $\mathbf{8}_n$ of the printing system 6. Those capabilities may increase over time due to addition of new processing units or upgrading of existing processing units.

Print jobs can be supplied to the printing system 6 in various ways. A built-in optical scanner 70 can be used to scan a document such as book pages, a stack of printed pages, or so forth, to create a digital image of the scanned document that is reproduced by printing operations performed by the printing system 6. Alternatively, one or more print jobs 72 can be electronically delivered to a controller 74 of the printing system 6 via a wired connection 76 from a digital network 80 that interconnects example computers 82, 84 or other digital devices. For example, a network user operating word processing software running on the computer 84 may select to print the word processing document on the printing system 6, thus generating the print job 72, or an external scanner (not shown) connected to the network 80 may provide the print job in electronic form. While a wired network connection 76 is illustrated, a wireless network connection or other wireless communication pathway may be used instead or additionally to connect the printing system 6 with the digital network 80. The digital network 80 can be a local area network such as a wired Ethernet, a wireless local area network (WLAN), the Internet, some combination thereof, or so forth. Moreover, it is contemplated to deliver print jobs to the printing system 6 in other ways, such as by using an optical disk reader (not illustrated) built into the printing system 6, or using a dedicated computer connected only to the printing system 6.

The printing system 6 is an illustrative example. In general, any number of print media sources, media handlers, marking engines, collators, finishers or other processing units can be connected together by a suitable print media conveyor configuration. While the printing system 6 illustrates a 2×2 configuration of four processing units $\mathbf{8}_2$, $\mathbf{8}_3$, $\mathbf{8}_4$, $\mathbf{8}_5$, each dedicated to include a marking engine, buttressed by the media feeding processing unit $\mathbf{8}_1$ on one end and by the finishing processing unit $\mathbf{8}_6$ on the other end, other physical layouts can be used, such as an entirely horizontal arrangement, stacking of processing units three or more units high, or so forth. Moreover, while in the printing system 6 the processing units $\mathbf{8}_2$, $\mathbf{8}_3$, $\mathbf{8}_4$, $\mathbf{8}_5$ have removable functional portions, in some other embodiments some or all processing units may have non-removable functional portions. It is contemplated that even if the marking engine portion of the marking engine processing unit is non-removable, associated upper or forward paper paths 22 through each marking engine processing unit enables the marking engines to be taken "off-line" for repair or modification while the remaining processing units of the printing system continue to function as usual.

In some embodiments, separate bypasses for intermediate components may be omitted. The "bypass path" of the conveyor in such configurations suitably passes through the functional portion of a processing unit, and optional bypassing of the processing unit is effectuated by conveying the sheet through the functional portion without performing any processing operations. Still further, in some embodiments the printing system may be a stand alone printer or a cluster of networked or otherwise logically interconnected printers, with each printer having its own associated print media source and finishing components including a plurality of final media destinations.

Although several media path elements are illustrated, other path elements are contemplated which might include, for example, inverters, reverters, interposers, and the like, as known in the art to direct the print media between the feeders, printing or marking engines and/or finishers.

The plurality of processing units $\mathbf{8}_1$, $\mathbf{8}_2$, $\mathbf{8}_3$, $\mathbf{8}_4$, $\mathbf{8}_5$, $\mathbf{8}_6$, $\mathbf{8}_7$, . . . , $\mathbf{8}_n$ interconnected by the flexible print media conveyor enables the printing system 6 to have a large number of capabilities and features. Each marking engine 10, 12, 14, for example, has associated low-level print settings such as xerographic voltages, fuser temperatures, toner reproduction curves, and so forth. Some of these low-level print settings are optionally modified depending upon the sequence along which a given sheet passes through the printing system 6; for example, it may be advantageous to modify the fusing temperatures of serially performed xerographic processes. At a higher functional level, each marking engine has associated functional parameters such as contrast, resolution, and so forth.

The user generally is not directly concerned about low-level print settings, or even about higher functional level parameters. Rather, the user has certain user preferences regarding performance of the printing system 6. The user ideally wants a highly efficient or productive printing (that is, a high throughput of sheets and print jobs through the printing system 6), high printing quality, image quality consistency across each print job, and so forth. At the same time, the user ideally wants the printing system 6 to maintain high reliability (that is, to minimize the down-time of the printing system 6), low run cost (achieved, for example, by minimizing cycling of processing units between idle and active states), low service costs (achieved, for example, by distributing usage of consumable elements across similar processing units), high energy efficiency, and so forth.

It will be appreciated that the user preferences are interrelated and generally not simultaneously fully attainable. As an example, the highest image quality may require use of large quantities of toner, whereas to minimize service costs the marking engines should use as little toner as possible. Thus, a trade-off is required between image quality and service costs. High productivity militates toward marking sheets in parallel by simultaneously running several marking engines; however, image quality consistency militates toward using only one or two marking engines having similar color characteristics. Similar tradeoffs are typically required between various others of the user preferences.

The controller 74 controls the production of printed sheets, the transportation over the media path, and the collation and assembly as job output by the finishing processing unit $\mathbf{8}_6$.

A scheduling component or processor 90 for the document processing system 6 enables operation of each processing unit $\mathbf{8}_1$, $\mathbf{8}_2$, $\mathbf{8}_3$, $\mathbf{8}_4$, $\mathbf{8}_5$, $\mathbf{8}_6$, $\mathbf{8}_7$, . . . , $\mathbf{8}_n$ within its operational range, without overstress. The scheduling processor 90 avoids the problem of overstress by recognizing print jobs such as, for example, low area coverage jobs, high area coverage jobs, high density graphics and the like, as stress causing jobs and employing one or more of the stress reducing methods, e.g., scheduling such jobs or portions of the jobs among multiple marking engines or scheduling such jobs concurrently with other jobs that dilute or counteract the stress.

More specifically, a sheet scheduler 92 interleaves images or sheets from different print jobs to alleviate stress to any particular processing unit and thus reduce its latitude requirements or range of continuous operation from mid-range operation. For example, the sheet scheduler 92 interleaves high area coverage sheets of a first print job with low area coverage sheets of a second print job to let the development subsystem of the particular marking engine recover from stress. Alternatively, a job scheduler 94 schedules jobs with varying demands on any particular processing unit to reduce its departure from nominal operational latitude. The overall performance of the printing system 6 is maintained; while the effective operation latitude of the printing system 6 is increased as discussed below.

The flexible reconfigurable architecture allows the scheduling processor 90 to simultaneously schedule and route multiple print jobs to multiple processing units in parallel to increase an operational latitude of the document processing system 6 over the operational latitude of any one of the individual processing units, e.g., the operational latitude or range of operations specific to each feeder, each marking engine, finisher, etc. as determined by operational instructions at the time of manufacture. For instance, the operational latitude of a color integrated marking engine can be specified as the capability to print an 8.5×11 sheet of paper which has a paper weight less than 120 gsm in 1.5 sec in a normal quality mode, to print an 8.5×11 sheet of paper which has a paper weight more than 120 gsm but less than 240 gsm in 3.5 sec in the normal quality mode, and so forth. As discussed below, the increased overall system latitude is achieved by providing constraints of each processing unit $\mathbf{8}_1$, $\mathbf{8}_2$, $\mathbf{8}_3$, $\mathbf{8}_4$, $\mathbf{8}_5$, $\mathbf{8}_6$, $\mathbf{8}_7$, . . . , $\mathbf{8}_n$ to the scheduling processor 90 such that no single processing unit $8_1$, $8_2$, $8_3$, $8_4$, $8_5$, $8_6$, $8_7$, . . . , $8_n$ is scheduled to produce a stress sequence, i.e. an extended sequence of printed pages that are outside that processing unit's natural or nominal or prespecified latitude. Instead, a stress sequence is distributed between multiple processing units and intermixed with a non-stress print sequence from other print jobs. Such approach reduces the short term average departures from the nominal operational latitude of the given processing unit and increases overall effective operational latitude of the document processing system. As a result, customers are able to print jobs that could not be printed as sequential sheets without compromising the document processing system performance.

Figure 2:
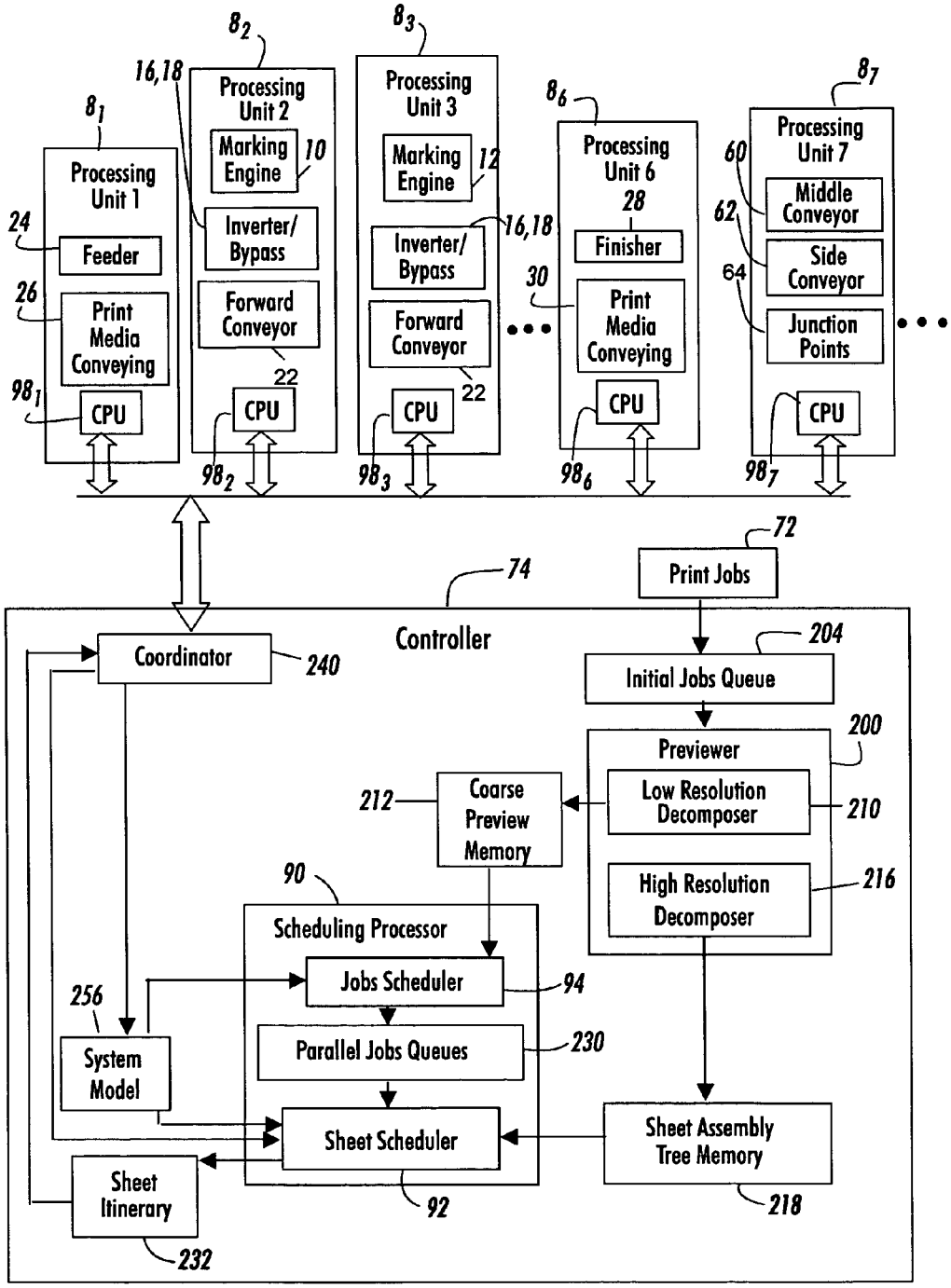
FIG. 2 is a block diagram of a modular document processing system.
Figure 3:
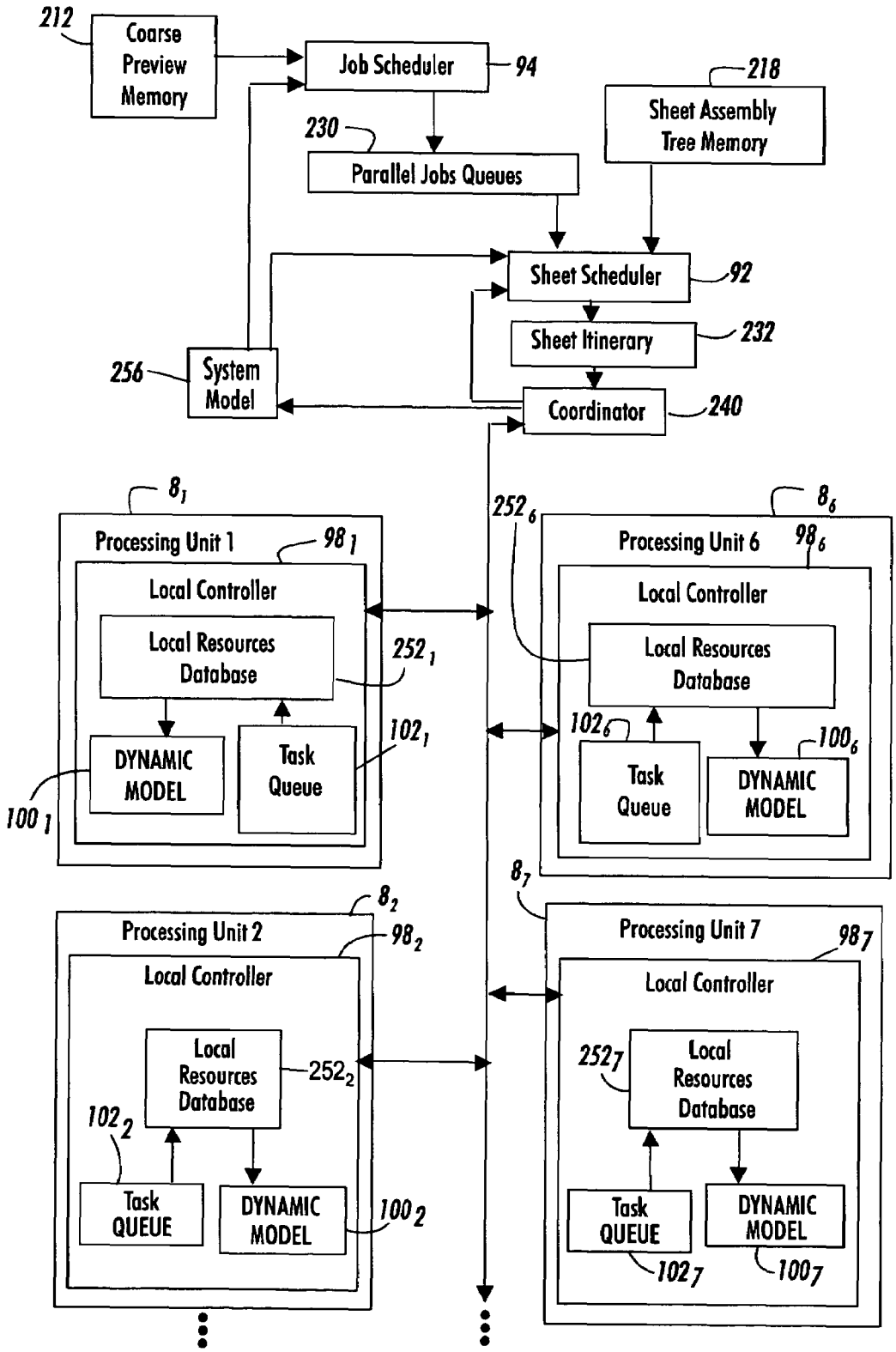
FIG. 3 is a portion of a detailed block diagram of a document processing system.

With continuing reference to FIG. 1 and further reference to FIGS. 2-3, each processing unit $8_1$, $8_2$, $8_3$, $8_4$, $8_5$, $8_6$, $8_7$, . . . , $8_n$ includes an associated local controller or CPU $98_1$, $98_2$, $98_3$, $98_4$, $98_5$, $98_6$, $98_7$, . . . , $98_n$, respectively, which controls the sheet processing for the associated processing unit, collects information about local capabilities and constraints, and creates a dynamic model $100_1$, $100_2$, $100_3$, $100_4$, $100_5$, $100_6$, $100_7$, . . . , $100_n$ of the associated processing unit as discussed in detail below. The dynamic models are descriptions of how the processing units move and transform sheets of the print jobs, generally together with information about the attributes and timing of the processing units. The models can include, for example, timing constraints, feature constraints, and commands. The timing and feature constraints describe when and how a capability can be applied to sheets of the print jobs. The examples of the timing constraints are the duration of execution of a capability, the time during which a capability is unavailable, and the reservation of a capability. Examples of the feature constraints are limits on the size of the print units being processed, and transformation of the images such as changing the orientation of the image or adding two images together. The examples of commands are identifications of operations associated with the print job. Each local controller $98_1$, $98_2$, $98_3$, $98_4$, $98_5$, $98_6$, $98_7$, . . . , $98_n$ includes an associated task queue $102_1$, $102_2$, $102_3$, $102_4$, $102_5$, $102_6$, $102_7$, . . . , $102_n$.

A previewer 200 previews each sheet of each incoming print job 72 which is scanned in or otherwise delivered to an initial jobs queue 204 which comprises conversion electronics, as known in the art, for converting the image and any associated information into a form which can be processed by the system 6. By a use of algorithms known in the art, the previewer 200 identifies traits or descriptions for print units of each sheet of each incoming print job. In one embodiment, the identified description is placed into a header associated with each previewed sheet. The job traits correspond to the descriptions of the desired output products. Examples of traits are media type, media size, media weight, media surface coating, media roughness, black pages, process color pages, custom color pages, header/footer/logo pages, magnetic ink character recognition pages (MICR), high area coverage pages, low area coverage pages, duplex option, binding option, and folding option. The marking engines may be capable of generating more than one type of print modality or the marking engines may be, for example, black only, process color, or custom color marking devices. Process color printers generally employ four inks or toners, magenta, cyan, and yellow, and optionally black. Different colors are achieved by superimposing images of the primary colors. Area coverages can be determined for each primary color image. Custom color printers are fed with a premixed ink which provides a specific color, generally with a higher color rendering accuracy than can be achieved with a process color printer. MICR printing applies a magnetic strip or other detectable portion to the page, for example, as a security feature for bank notes. The number of modalities is not limited to those listed herein. Some of the pages can be printed by use of more than one modality, e.g. mixed modality pages. For example, a page of the print job may have a custom color header applied by a custom color printer and a body of text in black or process color applied by a different printer. In such a case, the same page is broken into print units and is recycled or rerouted to the appropriate print modality.

The previewer 200 includes a first processing component or low resolution decomposer 210 which determines attributes of the print job including, for example, for each job, the total number of pages, the number of pages of each print modality (color, black, etc.) the number of pages to be printed on each substrate weight, the number of pages with an average area coverage of below a minimum threshold, and the like. The low resolution decomposer 210 provides only a coarse data analysis (less than all) of the information on the print job which is required for printing. The coarse preview data is stored in a coarse view memory 212. Such coarse information can be acquired in a relatively short period of time and forwarded to the job scheduler 94. The job previewer 200 further includes a second processing component or high resolution decomposer 216 which, for each sheet, lists the content of each page (i.e., front and back of the sheet) in terms of the image content and substrate type, etc. This fine analysis of the job content takes much longer than the coarse determination of job attributes. Information generated by the high resolution decomposer 216 is forwarded to the sheet scheduler 92 for scheduling printing of the individual pages of the jobs scheduled for printing by the job scheduler 94. The previewer 200 assigns an address to the image content of each sheet. The image content, together with its address is stored in a sheet assembly tree memory 218, to be transmitted later to the selected marking engine to print the sheet. The high resolution decomposer 216 can begin the creation of the sheet assembly tree at the same time or some time after the low resolution decomposer 210 performs the coarse analysis of job attributes.

The job scheduler 94 receives the job attributes for a plurality of jobs and assigns and sequences the jobs to parallel jobs queues 230, where the number of active parallel queues may vary. The maximum number of parallel job queues 230 typically depends on the number of finishing destinations. In assigning and sequencing the jobs to the parallel jobs queues 230, the job scheduler 94 attempts to produce the best fit of jobs to meet multiple objectives, such as module stress reduction, reduced job dwell time, higher sheet productivity, desired image quality or image quality consistency, for jobs being produced by the printing system 6 in view of the coarse preview of the job attributes.

The sheet scheduler 92 receives from the sheet tree assembly memory 218 each sheet of each print job and creates an itinerary for each sheet of each print job for processing in a sequential order in the interleaved fashion to prevent any single processing unit $8_1$, $8_2$, $8_3$, $8_4$, $8_5$, $8_6$, $8_7$, . . . , $8_n$ from overstress. The itineraries are stored in a sheet itinerary memory 232. A coordinator 240 receives a schedule or itinerary for each sheet of each print job and, according to the itinerary, controls the sheets flow in the document processing system 6 as discussed below.

With continuing reference to FIG. 3, each local controller $98_1$, $98_2$, $98_3$, $98_4$, $98_5$, $98_6$, $98_7$, . . . , $98_n$ of each respective processing unit $8_1$, $8_2$, $8_3$, $8_4$, $8_5$, $8_6$, $8_7$, . . . , $8_n$ collects local information about the corresponding processing unit's resources which information is stored in associated local resources database 252$_1$, 252$_2$, 252$_3$, 252$_4$, 252$_5$, 252$_6$, 252$_7$, . . . , 252$_n$. For example, the second processing unit controller 98$_2$ collects the information about the number of pages in the second processing unit task queue 102$_2$, the temperature of a second processing unit marking engine fuser, interconnections with other adjacent processing units, operational constraints, and other appropriate information, and stores such local information in the second processing unit local resources database 252$_2$. The second processing unit controller 98$_2$ dynamically models the second processing unit dynamic model 100$_2$ by using the local resources information and makes the model 100$_2$ available to the components of the printing system 6. For example, the first marking engine controller 98$_2$ provides the second processing unit model 100$_2$ to a system model 256.

Of course, it is also contemplated that dynamic models are created for other processing units of the document processing system 6 and provided to the system model 256. For example, the first processing unit dynamic model 100$_1$ can be created for the first processing module 8$_1$, the sixth processing unit dynamic model 100$_6$ can be created for the sixth processing unit 8$_6$, and the like.

Figure 4:
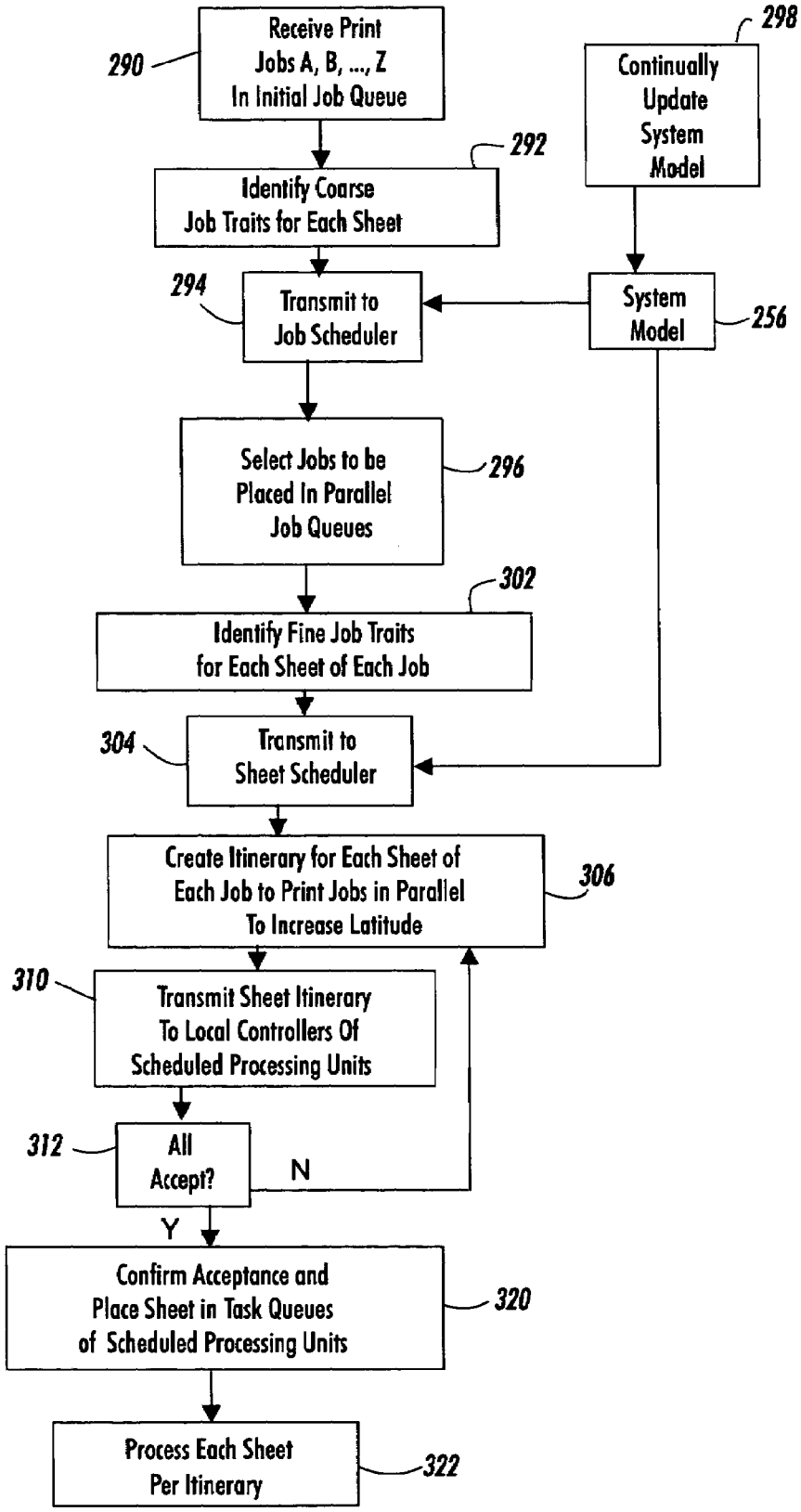
FIG. 4 is a flow chart of a scheduling process.

With continuing reference to FIG. 2 and further reference to FIG. 4, the print jobs A, B, . . . , Z are received 290 in the initial jobs queue 204. The low resolution decomposer 210 identifies 292 coarse traits for each sheet of each job A, B, . . . , Z. The identified coarse job traits are transmitted 294 to the job scheduler 94, which, based on the identified traits and the system model 256, selects 296 jobs with different traits to be placed in the parallel job queues 230. The system model 256 is initially created at the system power up. As the capabilities and constraints of each processing unit changes with time, the system model 256 is continually or periodically automatically updated 298. Such update may be performed each pre-specified time period or each time one of capabilities or constraints changes. Of course, it is contemplated that update can be triggered by a user. The high resolution decomposer 216 identifies 302 fine job traits for each sheet of each print job. The identified fine traits of each sheet of each print job are transmitted 304 to the sheet scheduler 92. The sheet scheduler 92 receives the dynamic system model 256. The sheet scheduler 92 creates 306 an itinerary for first, second, . . . , nth sheet of each print job to process the print jobs in parallel based at least on one of the system model, previewed traits and operational constraints of at least one processing unit. In one embodiment, the sheet scheduler 92 creates the itinerary for each sheet based at least on the dynamic model of at least one processing unit. As a result of scheduling, the effective operational latitude of the printing system 6 is increased.

For example, the sheet scheduler 92 can minimize time for a sheet passing through the printing engine subject to constraints. Constraints affect the choice of resources and the latitude of performance. An example of constraints that affect resources is a color image quality consistency. E.g., a job with color can be printed by marking engines whose comparative color performance is within a user specified range of color quality which is usually expressed as ΔE. Another example for a job with multiple copies of a document with color, where each document may be printed by the working engines whose comparative color performance is within a user specified range of color quality ΔE. For sheets within a color document, each sheet may be printed by the working engines whose comparative color performance is within a user specified range of color quality ΔE. For a sheet with no color, K or color marking engines can print the sheet. For pages within a color document, each page is printed by the marking engines whose comparative color performance is within a user specified range of color quality ΔE. For a page with no color, K or color marking engines can print the page. When ΔE=0, any one marking engine prints the job, sheet, page. When no color marking engine is available, a user preference/policy may allow the K marking engines to print a job with color, otherwise, the job is not printed because no resources are available to do so. Other constraints might be based on performance latitude considerations. For example, one of the marking engines can only print limited quantities of low area coverage pages consecutively depending upon the previous printing history. The working engine local controller puts together rules for alternating low and high area coverage. Another marking engine can only print and then fuse limited quantities of heavy weight paper, etc. Constraints may be placed by the user and entered via a suitable user interface. Example of user interface is a built-in user interface 308 shown in FIG. 1 which includes a display, keyboard or a touch screen, or other user input device. For example, the user's preference might be to minimize XEROX service calls and, therefore, to reduce load on the particular processing unit.

The coordinator 240 transmits 310 the itinerary of each sheet to the local controllers 98$_1$, 98$_2$, 98$_3$, 98$_4$, 98$_5$, 98$_6$, 98$_7$, . . . , 98$_n$ of one or more scheduled processing units 8$_1$, 8$_2$, 8$_3$, 8$_4$, 8$_5$, 8$_6$, 8$_7$, . . . , 8$_n$. Each local controller 98$_1$, 98$_2$, 98$_3$, 98$_4$, 98$_5$, 98$_6$, 98$_7$, . . . , 98$_n$ can accept or reject the itinerary. For instance, the sheet itinerary is sent to the first processing unit local controller 98$_1$, the second processing unit local controller 98$_2$, and the sixth processing unit local controller 98$_6$. The itinerary needs to be accepted 312 by each local controller 98$_1$, 98$_2$, 98$_6$. If all local controllers 98$_1$, 98$_2$, 98$_6$ determine that the capabilities are available, the itinerary of the sheet is confirmed by the coordinator 240 and the sheet is placed 320 in the queues of corresponding processing units. The sheet is processed 322 per itinerary. If one of the local controllers, such as the second processing unit local controller 98$_2$, determines that the capabilities are not available, the second processing unit local controller 98$_2$ can refuse to process the requested sheet of the print job. The sheet scheduler 92 creates a new itinerary for the rejected sheet of the print job with another processing unit, or a group of processing units. For example, the sheet scheduler 92 can interleave the rejected sheet of the print job with the sheets of another print job, e.g., the sheets of the print job which require lower capabilities than the rejected sheet can be processed by the rejecting processing unit while the rejecting processing unit recovers its resources to process the rejected sheet with a delay. Such interleaving of sheets reduces the stress on the processing units; thus, reducing individual unit's departures from the nominal operational range.

Job interleaving can be practiced to good advantage even with fairly rudimentary job scheduling algorithms and relatively simple printing systems, such as single print engine architectures with two or more output destinations for collecting printed jobs. Job scheduling algorithms with varying degrees of sophistication could be developed that emulate what a knowledgeable operator might do to rearrange and parallelize a job queue to improve the performance of a printing system.

In one embodiment, the job scheduler 94 sequences jobs and "job packets" in a serial fashion, where the sequencing of the jobs and job packets is determined by job priority or some other default or user defined preference criteria. The job scheduler initiates construction of a job packet by identifying and flagging "outlying" jobs, that is, jobs that cause stress or have some other attribute that is poorly matched with respect to system capabilities. For each outlying job, the job scheduler searches the job queue for complementary jobs, i.e., jobs that tend to dilute or counterbalance the outlying properties of the associated outlying job. With sufficient complementary jobs chosen, a packet of jobs including the outlier job and its complements is formed. The total number of jobs in this packet must be less than or equal to the number of finishing destinations in the printer as each job in the packet will have its own unique finishing destination assigned to it by the sheet scheduler. The sheet scheduler will thus be simultaneously scheduling sheets from all jobs in the packet, i.e., parallel printing the packet of outlier and complementary jobs so as to achieve better overall alignment with the system capabilities.

The job scheduler 94 then presents the sequenced jobs and job packets to the sheet scheduler 92. Sheets of jobs are scheduled for printing sequentially by the sheet scheduler 92, whereas sheets in job packets are scheduled alternately from multiple job queues for substantially contemporaneous printing of the jobs within the job packet. Further, "picking rules" can be assigned to a packet to proportion the packet requirements more closely to the system capabilities. For example, for a packet with two jobs, an outlier and a single complementary job, a picking rule such as "pick two sheets from the outlier, followed by one sheet from the complementary job; repeat until job is finished, then finish the other job" may be applied as a constraint to the sheet scheduler.

The utility of a packet is determined primarily by how well it matches system's capabilities. However, in general high priority jobs are assigned to different packets from low priority jobs. For each flagged job, criteria may be set for what is an acceptable packet (which need not necessarily be an optimal packet). If any packet does can not meet the criteria, previously formed packets may be reworked, or fall back criteria can be established for passing substandard packets or stand alone flagged jobs. Some of the job packets may include jobs which are neither flagged jobs nor complementary jobs. Job packets may also include jobs which are scheduled for contemporaneous printing along with the flagged and complementary jobs.

The degree to which a print job is considered to be an outlier can depend on the default constraints of the printing system. Alternatively, user selected constraints may impact whether a job is considered to be an outlier. Table 1 lists exemplary outlier and complementary jobs which can be combined into a packet.

TABLE 1

| EXAMPLE JOBS TO BE FLAGGED | POTENTIAL COMPLEMENTARY JOBS FOR A PACKET |
|---|---|
| Extended run monochrome jobs with low average area coverage | monochrome jobs normal to high average area coverage |
| Extended run process color jobs with low average area coverage for a given color separation | Process color jobs with normal to high average area coverage for the same given color separation |
| Extended run monochrome jobs with high average area coverage | monochrome jobs normal to low average area coverage |
| Extended run process color jobs with high average area coverage for a given color separation | Process color jobs with normal to low average area coverage for the same given color separation |
| Predominantly monochrome jobs with repetitive high density areas | predominantly monochrome jobs without high density areas |
| Predominantly process color jobs with repetitive high density areas | predominantly process color jobs without high density areas |
| Jobs with proportionally low number of black pages relative to system capability | jobs with proportionally high number of black pages relative to system capability |
| Jobs with proportionally low number of process color pages relative to system capability | jobs with proportionally high number of process color pages relative to system capability |
| Predominantly monochrome jobs with high image quality requirements | Predominantly monochrome jobs with normal to low image quality requirements for black pages |
| Predominantly process color jobs with high image quality requirements | Predominantly process color jobs with normal to low image quality requirements |
| Predominantly monochrome jobs with heavy stock | Predominantly monochrome jobs with normal to light weight stock |
| Predominantly process color jobs with heavy stock | Predominantly process color jobs with normal to light weight stock |

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A method comprising:

receiving first and second print jobs, each of the first and second print jobs including a plurality of sheets to be processed;

determining current operational capabilities of at least one processing unit of a document processing system, which processing unit has a predetermined nominal operational latitude, at least one of the first and second print jobs tending to cause a departure from the nominal operational latitude of the at least one processing unit;

scheduling a sequence of interleaved sheet processing of the sheets of the first and second print jobs by the same at least one processing unit based at least on a determination of the operational capabilities of the processing unit, whereby:

short term departures from the nominal operational latitude of the processing unit are reduced, on average; and an operational latitude of the document processing system is increased.

2. The method of claim 1, further including:

prior to scheduling, previewing each sheet of each print job;

performing a low resolution decomposition on each print job;

identifying coarse job traits for each previewed print job;

placing the print jobs in parallel job queues to be processed in parallel based at least on one of identified varying job traits and determined operational capabilities of the processing unit; and processing the print jobs in parallel with the processing unit.

3. The method of claim 1, further including;

high resolution decomposing each print job;

identifying fine traits for each sheet of each print job;

scheduling a sequential sheet processing of the sheets of each print job in the interleaved fashion based at least on one of the identified fine traits and determined current operational capabilities of the processing unit; and processing the print jobs in parallel with the processing unit.

4. The method of claim 3, wherein the identified fine traits include at least one of:

low area coverage, high area coverage, media type, media weight, media coating;

media roughness, media size, and repetitive high density graphics.

5. The method of claim 3, wherein the step of determining current operational capabilities includes:

creating a local dynamic model of one or more processing units;

creating a system model based on the local dynamic models; and scheduling the interleaved sheet processing with selected processing units based at least on one of the system model and identified fine traits.

6. The method of claim 5, further including:

automatically updating each local model; and automatically periodically updating the system model.

7. The method of claim 5, further including:

requesting the selected processing units to process each scheduled sheet.

8. The method of claim 6, further including:

one of accepting the scheduled sheet by each selected processing unit and rejecting the scheduled sheet by at least one processing unit.

9. The method of claim 7, further including one of:

rescheduling the processing of the rejected sheet; and confirming the processing of the accepted sheet with the selected processing units.

10. A document processing system including:

processing units which at least include:

a media feeding processing unit which includes a feeder for storing a plurality of individual media sheets, a marking engine processing unit which includes a marking engine in operative communication with the feeder for receiving media sheets from the feeder and marking a series of individual media sheets, and a finishing processing unit which includes finishing destinations in operative communication with the marking engine, which finishing destinations receive and accumulate a series of individual marked media sheets from the marking engine; and a scheduler which receives print jobs each having a plurality of sheets to be processed and schedules a series of consecutive sheets of each received print job to be processed with the media feeding, marking engine, and finishing processing units in an interleaved fashion, such that a first print job which tends to cause a departure from a nominal operational latitude of one of the processing units is interleaved with sheets of a second print job on that processing unit.

11. The system of claim 10, wherein at least one marking engine includes a xerographic marking engine.

12. The document processing system of claim 10, further including:

a previewer which previews each sheet of each received print job and including:

a low resolution decomposer which initially previews each print job to roughly identify coarse job traits; and a job scheduler which selects jobs based at least on varying coarse job traits and places the job with varying coarse job traits in parallel job queues.

13. The system of claim 12, further including:

a high resolution decomposer which identifies fine traits of each sheet of each print job.

14. The system of claim 13, wherein each processing unit includes a local controller which determines a local processing unit dynamic model based on capabilities and constraints of an associated processing unit.

15. The system of claim 14, further including:

a system model processor which determines a dynamic system model of the document processing system based on the determined local models; and wherein the scheduler schedules processing of the interleaved sheets based at least on one of the system model and the identified fine traits.

16. A document processing system, comprising:

a previewer which previews sheets of each received print job to identify outlier jobs based on identified job traits, the identified job traits of an outlier job including at least one of:

low area coverage, high area coverage, media type, media weight, media surface coatings, media roughness, media size, and repetitive high density graphics; and a job scheduler which packages an outlier job with a complementary job as a packet, based at least on identified job traits; and a sheet scheduler which schedules printing of sheets of jobs in a packet that includes an outlier job and a complementary job substantially contemporaneously by the processing system.

17. The system of claim 10, wherein the interleaved sheet processing of the print jobs provides increased operational latitude for the document processing system in relation to an expected operational latitude for the document processing system.

18. A method comprising:

receiving print jobs each including a plurality of sheets to be processed;

determining operational capabilities and constraints of processing units of a document processing system, which each processing unit has a predetermined nominal operational latitude;

scheduling a processing of the print jobs in parallel with selected alike processing units based at least on determination of the operational capabilities of the processing units, whereby:

short term average departures from the nominal operational latitude of at least one of the processing units are reduced; and the nominal operational latitude of the document processing system is increased.

19. The method of claim 18, further including:

creating a dynamic model of the document processing system based on information provided by individual controllers of each of the processing units; and scheduling parallel processing of the print jobs based at least on the system model.

20. The method of claim 18, further including:

identifying coarse traits of each print job; and scheduling parallel processing of the print jobs with at least two alike processing units based at least on varying coarse job traits.

21. The method of claim 18, further including:

identifying fine traits of each sheet of each print job; and scheduling the print jobs to be processed in parallel with at least two alike processing units based at least on the identified fine job traits.

* * * * *

UNITED STATES PATENT AND TRADEMARK OFFICE

CERTIFICATE OF CORRECTION

PATENT NO. : 7,302,199 B2
APPLICATION NO. : 11/136959
DATED : November 27, 2007
INVENTOR(S) : Kristine A. German et al.

It is certified that error appears in the above-identified patent and that said Letters Patent is hereby corrected as shown below:

Title Page, field (75) Inventors, after Robert M. Lofthus, Webster, NY (US), the following inventors should be listed:

Yongsoon Eun, Webster, NY (US); Eric S. Hamby, Fairport, NY (US)

Signed and Sealed this

Fourteenth Day of October, 2008

JON W. DUDAS
*Director of the United States Patent and Trademark Office*